United States Patent [19]

Langen et al.

[11] 4,306,633

[45] Dec. 22, 1981

[54] BAG TRANSFER MEANS

[75] Inventors: Marinus J. M. Langen; Edgars H. Strauss, both of Rexdale, Canada

[73] Assignee: H. J. Langen & Sons Limited, Rexdale, Canada

[21] Appl. No.: 114,292

[22] Filed: Jan. 22, 1980

[51] Int. Cl.[3] ..... B31B 1/76

[52] U.S. Cl. ..... 186/66; 53/390

[58] Field of Search ..... 53/459, 390, 385; 186/66, 69

[56] References Cited

U.S. PATENT DOCUMENTS 4,068,451 1/1978 Bewerse et al. ..... 53/390 X

*Primary Examiner*—Stanley H. Tollberg

*Attorney, Agent, or Firm*—Fetherstonhaugh & Co.

[57] ABSTRACT

A transfer mechanism which is particularly suitable for use in a checkout counter as described herein. The mechanism includes a bag supporting receptacle and a mount for mounting the bag supporting receptacle for pivotal movement between a first position in which it is generally horizontally oriented and aligned with the discharge end of a bag making machine and a second position in which it is disposed above a conveyor. The conveyor has discharge fingers which extend through a bag supporting receptacle as the conveyor is driven along its length to discharge a bag from the receptacle whereupon the receptacle is relocated in a position to receive a further bag.

10 Claims, 3 Drawing Figures

BAG TRANSFER MEANS

FIELD OF INVENTION

This invention relates to a transfer mechanism for transferring an open bag from the dispenser opening of a bag making machine to a conveyor and a checkout counter incorporating such a mechanism.

RELATED APPLICATIONS AND PRIOR ART

The present invention is closely related to the inventions described in our co-pending application Ser. No. 958,429 filed Nov. 7, 1978 and application Ser. No. 055,046 filed July 5, 1979 and preferably incorporates a bag making apparatus of the type described in co-pending application Ser. No. 910,737 filed May 30, 1978.

SUMMARY OF INVENTION

In application Ser. No. 958,429, I have described a transfer apparatus for transferring a bag to the conveyor of a checkout counter in which the open bag is discharged from the bag making machine onto a moveable platform from which it is transferred laterally onto the conveyor.

We have now developed an improved transfer mechanism which permits the open bag to be transferred directly onto the conveyor thereby reducing the number of steps in the transfer of the open bag and, thus, reducing the likelihood of a jam-up occurring during the transfer.

According to one aspect of the present prevent, there is provided a transfer mechanism comprising a bag from a bag making machine to a conveyor wherein the bag making machine has a dispenser opening disposed above and laterally spaced from the portion of the conveyor onto which the bag is to be loaded comprising a bag support means for supporting a bag in an open configuration, mounting means mounting said bag support means for movement between a first position in which said bag support means is aligned with said dispenser passage of said bag making machine to receive a bag and a second position in which said bag support means is aligned with said portion of said conveyor to support the bag in a generally upright upwardly opening configuration overlying said portion of said conveyor and discharge means on said conveyor for engaging a bag supported by said bag support means in said overlying position in response to movement of said conveyor along the conveyor path to discharge a bag from the bag support means onto said conveyor.

According to a further aspect of the present invention, there is provided in a checkout counter having a housing, a bag transfer station in said housing, a bag making machine in said housing having a dispenser opening arranged to dispense an open bag, bottom first along a dispenser path extending in a first direction, the improvement of a conveyor in said housing extending through said transfer station along a conveyor path which extends transversely of said dispenser path, bag support means in said housing for supporting a bag in an open configuration; mounting means mounting said bag support means in said housing for movement between a first position in which said bag support means is aligned with said dispenser passage of said bag making machine to receive a bag and a second position in which said bag support means is aligned with said portion of said conveyor to support a bag in a generally upright opening configuration overlying said portion of said conveyor, and discharge means on said conveyor for engaging a bag supported by said bag support means in said overlying position in response to movement of the conveyor along said conveyor path to discharge a bag from said bag support means onto said conveyor.

PREFERRED EMBODIMENT

The invention will be more clearly understood after reference to the following detailed specification read in conjunction with the drawings wherein.

Figure 1:
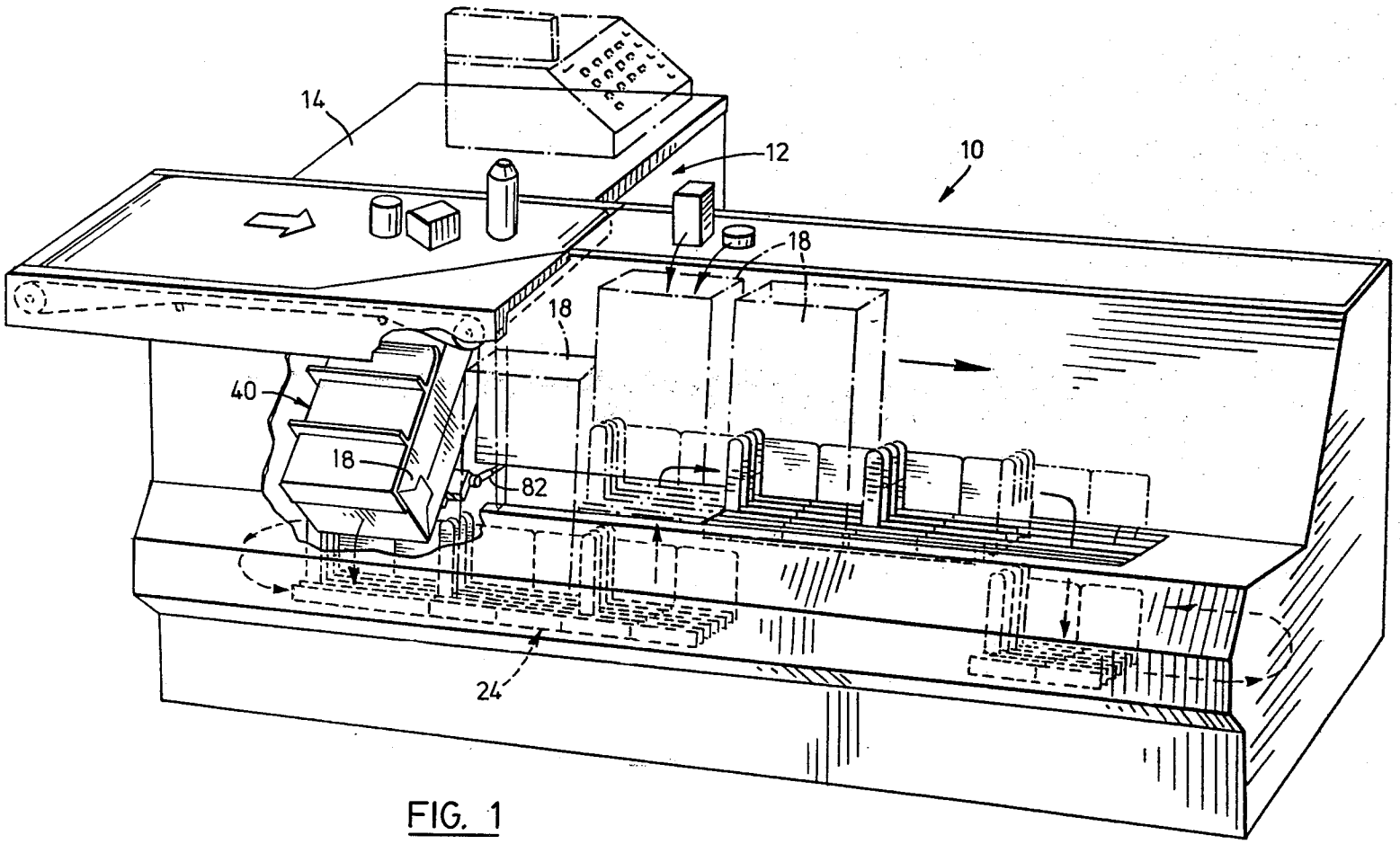
FIG. 1 is a pictorial front view of a checkout counter constructed in accordance with an embodiment of the present invention.

With reference to FIG. 1 of the drawings, reference numeral 10 refers generally to a checkout counter of the type described in our co-pending application Ser. Nos. 055,046 filed July 5, 1979 and 958,429 filed Nov. 7, 1978 in which a bag making machine of the type described in co-pending application Ser. No. 910,737 filed May 30, 1978 is incorporated. The entire specifications of the three applications identified above are incorporated herein by reference and, for this reason, the following description is limited to the differences between the structure of the present invention and that of the prior applications.

The improvement of the present invention is in the provision of an improved transfer of the bag from the bag making machine to the conveyor used for transporting the bag through the checkout counter. The bag making machine 12 is located within the counter housing 14 and has a dispenser opening 16 arranged to discharge bags 18, bottom first, in the direction of the arrow 20 in a generally horizontal plane which extends substantially at right angles to the direction of forward movement of the forward run 22 of the conveyor which is generally identified by the reference numeral 24. The conveyor differs from that previously described in application Ser. No. 055,046 and 958,429 in that the forward run portion 22 extends across the dispenser path along which bags are dispensed from the bag making machine. This serves to eliminate the need for a substantial portion of the transfer mechanism and it obviates difficulties which were experienced in attempting to locate a bag on a portion of the conveyor which was extending in an arc around the end of the conveyor. The conveyor 24 is otherwise constructed substantially as described in application Ser. No. 055,046 and includes an elevator mechanism for raising and lowering the transporter sections. The conveyor 24 has a bottom wall 26 and a side wall 28 extending upwardly from the bottom wall to the edge 30. Pusher fingers 32 project upwardly from the bottom wall 26 over a portion of the width of the bottom wall. It will be noted, however, that they do not extend upwardly over the full width of the bottom wall. The bags 18 are dispensed into a receptacle generally identified by the reference numeral 40 which acts as a bag support means and which includes an inner wall 42, an outer wall 44, a back wall 46 and a bottom wall 48 which co-operate with one another to define a bag supporting compartment 50. An input opening 52 opens inwardly at the upper end of the receptacle 40 into the compartment 50 and a discharge opening 54 opens outwardly at the front end of the compartment 50. A through passage 56 opens through the back wall 46 and bottom wall 48 to permit the fingers 32 to pass therethrough in use as will be described hereinafter.

Figure 2:
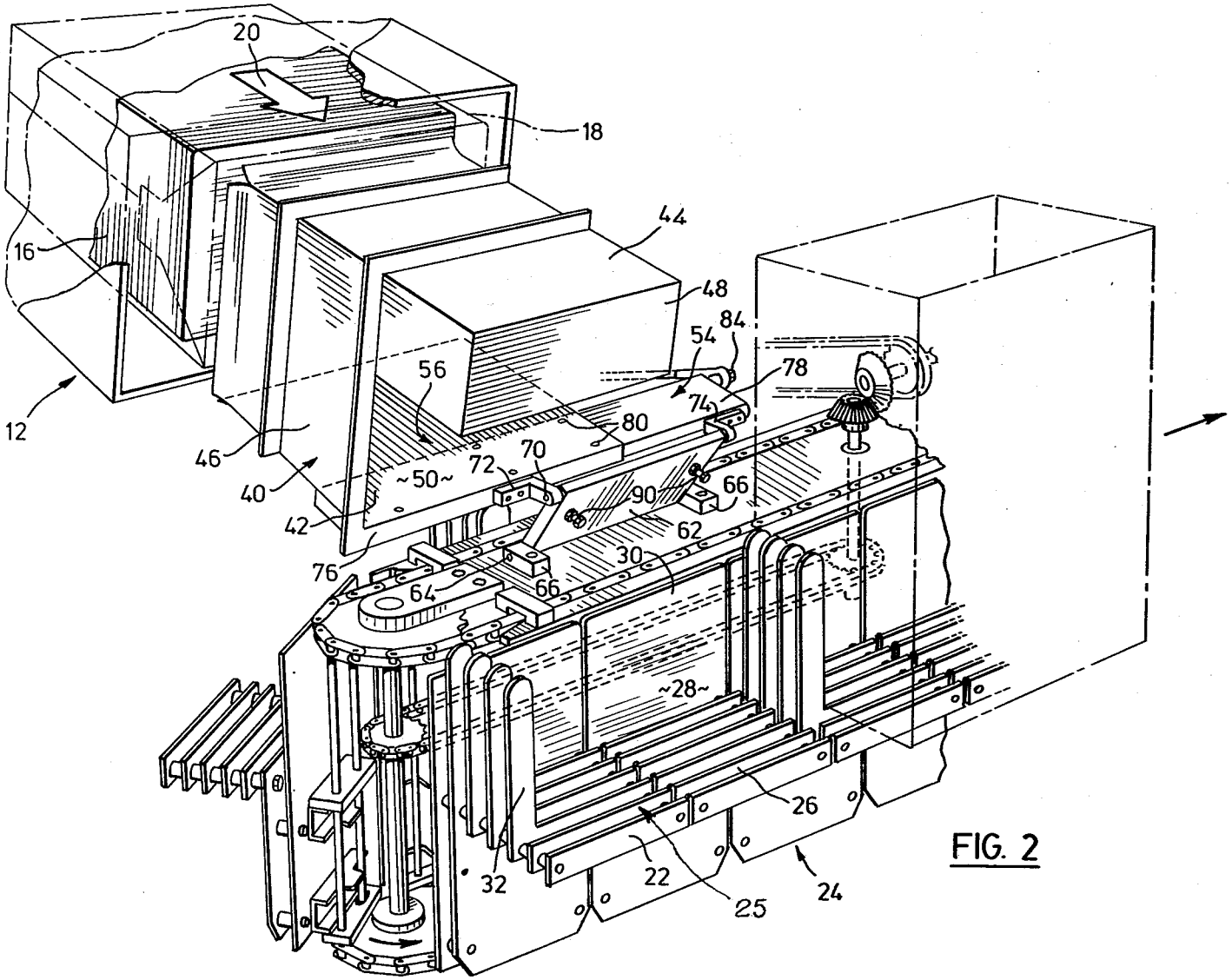
FIG. 2 is a pictorial view illustrating the transfer mechanism with the transfer receptacle located in the first position.

Mounting means generally identified by reference numeral 60 is provided for supporting the receptacle 40 for movement between a first position in which the input opening 52 is aligned with the dispenser passage 16 of the bag making machine to receive a bag and a second position in which it is aligned with a portion of the conveyor to support the bag in a generally upright configuration. The first position of the receptacle 40 is shown in solid lines in FIGS. 2 and 3 and the second position is shown in broken lines in FIG. 3. An intermediate position is also shown in broken lines in FIG. 3.

The mounting means 60 consists of a link arm 62 which is in the form of a flat, rectangular plate which has a first end pivotally mounted for rotation about pivot pins 64 in brackets 66 carried by the conveyor support frame 68. The second end of the link arm 62 is pivotally mounted by means of pivot pins 70 in brackets 72 and 74. The brackets 72 are mounted on the flange 76 which projects laterally outwardly from the inner wall 42 of the receptacle 40. The brackets 74 are mounted on a support 78 which is secured to the front wall 42 by means of a plurality of mounting screws 80. A reciprocating connecting rod 82 has a pivot pin 84 at one end thereof pivotally mounting it to the support plate 78. The other end of the rod 82 is pivotally connected to one end of a rocket arm by means of a pivot pin 88. The rocker arm 86 is pivotally mounted on a shaft 136 which is supported by support brackets 138 which are carried by the frame in a manner similar to that in which the corresponding elements are supported in application Ser. No. 958,429. Similarly, a reciprocating rod 142 extends to a control mechanism controlled by a cam operated by the cam shaft of the bag making machine so that movement of the transfer mechanism is synchronized with the operation of the bag making machine.

The first stop member in the form of a pair of set screws 90 is provided on the link arm 62 for limiting the pivotal movement of the link arm in a first direction away from the dispenser opening of the bag making machine. The stops 90 are adjustable with respect to the link arm 62 so that fine adjustment of the arresting position of the link arm 62 with respect to the frame 68 may be obtained. A second stop member in the form of roller 92 is supported by means of a frame member 94 from the frame of the counter. The roller 92 underlies the inner wall 42 of the receptacle 40 and is free to rotate to facilitate the movement of the inner wall 42 therealong.

Figure 3:
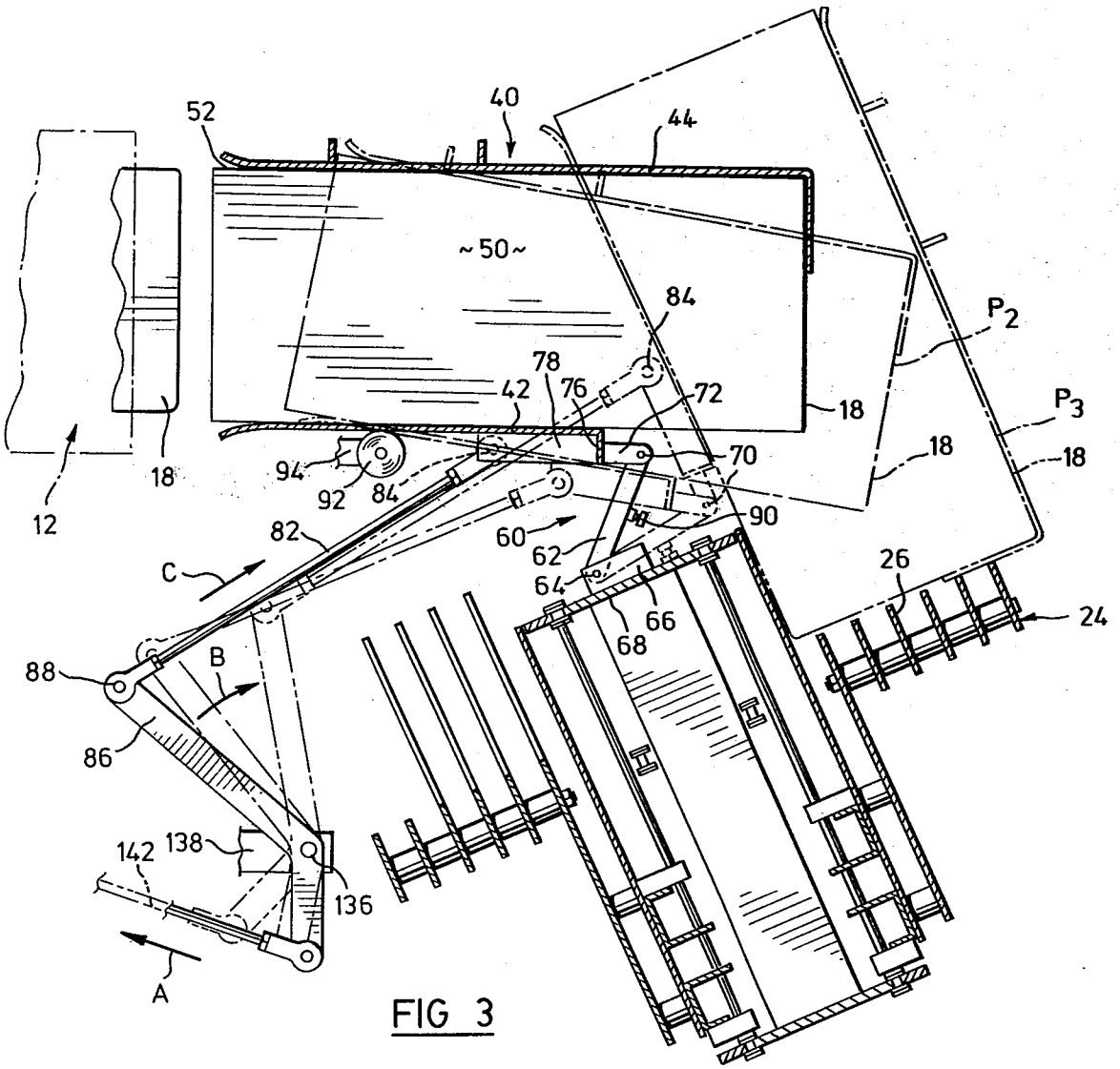
FIG. 3 is a sectional end view through the mechanism of FIG. 1.

In use, as soon as the receptacle 40 is positioned in the position shown in solid lines in FIGS. 1 and 3 of the drawings, the bag making machine is activated to manufacture a bag and to dispense the bag through the dispenser opening 16, bottom first, into the bag receiving compartment 50 of the receptacle 40. Simultaneously, the main conveyor 24 is indexed to position an empty transporter 25 in the transfer station. The rod 142 is, then, driven in the direction of the arrow A which causes rotation of the rocker arm in the direction of the arrow B which causes the connecting rod 82 to be driven in the direction of the arrow C. Initially, the mounting mechanism will pivot about both pivot pins 64 and 70 until the stop 90 is arrested by the support frame 68. This initial movement causes the receptacle 40 to move along a gentle arc of curvature from the position shown in solid lines in FIG. 2 to the intermediate position P2 shown in broken lines in FIG. 3. In moving along this first section of the transfer path, the receiver is supported by the support rollers 92. Continued movement of the rocker arm in the direction of the arrow B causes pivotal movement of the receptacle 40 about the axis of the pivot pins 70 until the receptacle arrives at the second position shown in broken lines at P3 in FIG. 3, wherein it serves to support a bag in an upright position overlying the bottom wall 26 of the conveyor transporter 25.

Thereafter, in response to a demand signal initiated by the operator, the conveyor is indexed forward by the length of one transporter section 25. The fingers 32 pass through the through passage 56 and drive an open bag outwardly from the receptacle through the discharge opening 54. Thereafter, the rocker arm 86 is driven in the reverse direction to that previously described to cause initial rotation about the pivot pins 70. This initial rotation will continue until the inner wall 42 of the receptacle engages the second stop roller 92. Thereafter, pivoting will occur with both pivot pins 72 and pivot pins 64 until the receptacle is returned to its first position to receive a further bag.

From the foregoing description of the operation of the mounting mechanism, it will be seen that the receptacle travels along a generally arcuate path from the first position to the second position, the path including a first section derived from pivoting about pivot pins 70 and 64 and a second section derived from pivoting about pivot pins 70 only.

While the transfer mechanism of the present invention is described in association with a checkout counter, it will be understood that the apparatus may also serve to locate a bag on a conveyor which is used in a bag loading machine of a type other than a checkout counter.

What we claim as our invention is:

1. In a checkout counter having a housing, a bag transfer station in said housing, a bag making machine in said housing having a dispenser opening arranged to dispense an open bag, bottom first along a dispenser path extending in a first direction, the improvement of:

(a) a conveyor in said housing, a portion of said conveyor extending through said transfer station along a conveyor path which extends transversely of said dispenser path;

(b) bag support means in said housing for supporting a bag in an open configuration; said bag support means comprises a receptacle having a bag supporting compartment therein, an input opening at one end of the receptacle proportioned to admit an open bag to said compartment, a discharge opening at one side of said receptacle proportioned to permit an open bag to discharge laterally from said compartment, a through passage extending laterally through said compartment through which said discharge means of said conveyor may travel to effect lateral discharge of an open bag from said compartment through said discharge opening, (c) mounting means mounting said bag support means in said housing for movement between a first position in which said bag support means is aligned with said dispenser passage of said bag making machine to receive a bag and a second position in which said bag support means is aligned with said portion of said conveyor to support a bag in a generally upright upwardly opening configuration overlying said portion of said conveyor, said mounting means comprising a link arm having a first end and a second end, the first end being pivotally mounted inwardly of said arcuate path whereby said link arm may pivot in a second arc about said first end in a second path extending transversely of the direction of movement of the portion of the conveyor which is located in the transfer station, the second end being pivotally connected with respect to said bag support means, first stop means for limiting the movement of the link arm in a first direction away from the dispenser opening of the bag making machine, second stop means disposed more closely adjacent the dispenser opening of the bag making machine and arranged to underlie and support said bag support means during travel of said bag support means on a first portion of said arcuate path, a reciprocating drive member having a first end pivotally mounted with respect to said bag support means above the pivotal connection of said second end of said lever arm and the second end pivotally mounted on a reciprocating drive means disposed inwardly from and below said transfer path whereby when said reciprocating drive member is activated to effect movement of said receptacle from said first position along a first section of said transfer path, said mounting means articulates about said first and second ends of said link arm until movement of the link arm is arrested by said first stop means and thereafter said mounting means pivots about said second end of said link arm to effect movement of said bag support means along a second section of said path to said second position, and whereby said reciprocating drive member is actuated to effect movement of said receptacle from said second position towards said first position along said second section of said path, articulation is substantially limited to pivoting about said second end of said link arm until movement of said receptacle along said second section of said path is arrested by said second stop means after which articulation is effected about both said first and second ends of said link arm during movement of said receptacle along said first section of said path towards said first position;

(d) discharge means on said conveyor for engaging a bag supported by said bag support means in said overlying position in response to movement of the conveyor along said conveyor path to discharge a bag from said bag support means onto said conveyor; and (e) said mounting means being adapted to transport said bag support means along a generally arcuate path extending outwardly and downwardly from said first position to said second position.

2. In a checkout counter having a housing, a bag transfer station in said housing, a bag making machine in said housing having a dispenser opening arranged to dispense an open bag, bottom first along a dispenser path extending in a first direction, the improvement of:

(a) a conveyor in said housing, a portion of said conveyor extending through said transfer station along a conveyor path which extends transversely of said dispenser path, (b) bag support means in said housing for supporting a bag in an open configuration, said bag support means comprises a receptacle having a bag supporting compartment therein, an input opening at one end of the receptacle proportioned to admit an open bag to said compartment, a discharge opening at one side of said receptacle proportioned to permit an open bag to discharge laterally from said compartment, a through passage extending laterally through said compartment through which said discharge means of said conveyor may travel to effect lateral discharge of an open bag from said compartment through said discharge opening, said receptacle comprises an inner wall, an outer wall, a side wall extending between the inner wall and the outer wall partially closing the sides of the receptacle which is located upstream of the direction of movement of the portion of the conveyor which the receptacle overlies when located in said second position and a bottom wall partially closing the bottom end;

(c) mounting means mounting said bag support means in said housing for movement between a first position in which said bag support means is aligned with said dispenser passage of said bag making machine to receive a bag and a second position in which said bag support means is aligned with said portion of said conveyor to support a bag in a generally upright upwardly opening configuration overlying said portion of said conveyor; and (d) discharge means on said conveyor for engaging a bag supported by said bag support means in said overlying position in response to movement of the conveyor along said conveyor path to discharge a bag from said bag support means onto said conveyor.

3. In a checkout counter having a housing, a bag transfer station in said housing, a bag making machine in said housing having a dispenser opening arranged to dispense an open bag, bottom first along a dispenser path extending horizontally in a first direction, the improvement of:

(a) a conveyor in said housing, a portion of said conveyor extending through said transfer station along a conveyor path which extends transversely of said dispenser path and is disposed below and outwardly from the dispenser opening, (b) bag support means in said housing for supporting a bag in an open configuration, said bag support means comprises a receptacle having a bag supporting compartment extending longitudinally from an input opening at one end thereof which is proportioned to admit an open bag to said compartment, a discharge opening at one side of said receptacle proportioned to permit an open bag to discharge laterally from said compartment, a through passage extending laterally through said compartment through which said discharge means of said conveyor may travel to effect lateral discharge of an open bag from said compartment through said discharge opening;

(c) mounting means mounting said bag support means in said housing for movement between a first position in which said input opening of said compartment bag is aligned with said dispenser passage and the longitudinal extent of the compartment extends in said dispenser path of said bag making machine to receive a bag and a second position in which said compartment is disposed directly above said portion of said conveyor with said discharge opening aligned with the direction of movement of said portion of said conveyor and the longitudinal extent of the compartment extending upwardly from the conveyor to support a bag in a generally upright upwardly opening configuration overlying said portion of said conveyor; and (d) discharge means on said conveyor for engaging a bag supported by said bag support means in said overlying position in response to movement of the conveyor along said conveyor path to discharge a bag from said bag support means onto said conveyor.

4. A checkout counter as claimed in claim 3, wherein said conveyor comprises bottom support means arranged to underlie a bottom of a bag disposed in an upright configuration and side support means extending upwardly from one edge of the bottom support means, said side support means having an upper edge disposed a substantial distance above said bottom support.

5. A checkout counter as claimed in claim 3 wherein said mounting means is adapted to transport said bag support means along a generally arcuate path extending outwardly and downwardly from said first position to said second position.

6. A checkout counter as claimed in claim 3 wherein said receptacle comprises an inner wall, an outer wall, a side wall extending between the inner wall and the outer wall partially closing the sides of the receptacle which is located upstream of the direction of movement of the portion of the conveyor which the receptacle overlies when located in said second position and a bottom wall partially closing the bottom end.

7. A checkout counter as claimed in claim 5 wherein said mounting means comprises (a) a link arm having a first end and a second end, the first end being pivotally mounted inwardly of said arcuate path whereby said link arm may pivot in a second arc about said first end in a second path extending transversely of the direction of movement of the portion of the conveyor which is located in the transfer station, the second end being pivotally connected with respect to said bag support means, first stop means for limiting the movement of the link arm in a first direction away from the dispenser opening of the bag making machine, second stop means disposed more closely adjacent the dispenser opening of the bag making machine and arranged to underlie and support said bag support means during travel of said bag support means on a first portion of said arcuate path, a reciprocating drive member having a first end pivotally mounted with respect to said bag support means above the pivotal connection of said second end of said lever arm and the second end pivotally mounted on a reciprocating drive means disposed inwardly from and below said transfer path whereby when said reciprocating drive member is activated to effect movement of said receptable from said first position along a first section of said transfer path, said mounting means articulates about said first and second ends of said link arm until movement of the link arm is arrested by said first stop means and thereafter said mounting means pivots about said second end of said link arm to effect movement of said bag support means along a second section of said path to said second position, and whereby said reciprocating drive member is actuated to effect movement of said receptacle from said second position towards said first position along said second section of said path, articulation is substantially limited to pivoting about said second end of said link arm until movement of said receptacle along said second section of said path is arrested by said second stop means after which articulation is effected about both said first and second ends of said link arm during movement of said receptacle along said first section of said path towards said first position.

8. A transfer mechanism for transferring a bag from a bag making machine to a conveyor wherein the bag making machine has a dispenser opening disposed above and laterally spaced from the portion of the conveyor onto which the bag is to be loaded, the bag making machine being arranged to dispense bags, bottom first, along a horizontal dispenser path in a first direction, comprising:

(a) bag support means in said housing for supporting a bag in an open configuration, said bag support means comprises a receptacle having a bag supporting compartment extending longitudinally from an input opening at one end thereof which is proportioned to admit an open bag to said compartment, a discharge opening at one side of said receptacle proportioned to permit an open bag to discharge laterally from said compartment, a through passage extending laterally through said compartment through which said discharge means of said conveyor may travel to effect lateral discharge of an open bag from said compartment through said discharge opening;

(b) mounting means mounting said bag support means in said housing for movement between a first position in which said input opening of said compartment bag is aligned with said dispenser passage and the longitudinal extent of the compartment extends in said dispenser path of said bag making machine to receive a bag and a second position in which said compartment is disposed directly above said portion of said conveyor with said discharge opening aligned with the direction of movement of said portion of said conveyor and the longitudinal extent of the compartment extending upwardly from the conveyor to support a bag in a generally upright upwardly opening configuration overlying said portion of said conveyor; and (c) discharge means on said conveyor for engaging a bag supported by said bag support means in said overlying position in response to movement of the conveyor along said conveyor path to discharge a bag from said bag support means onto said conveyor.

9. A transfer mechanism as claimed in claim 8, wherein said conveyor comprises bottom support means arranged to underlie a bottom of a bag disposed in an upright configuration and side support means extending upwardly from one edge of the bottom support means, said side support means having an upper edge disposed a substantial distance above said bottom support.

10. A transfer mechanism as claimed in claim 8, wherein said mounting means is adapted to transport said bag support means along a generally arcuate path extending outwardly and downwardly from said first position to said second position.

* * * * *